US011754300B2

(12) United States Patent
Lamoureux

(10) Patent No.: US 11,754,300 B2
(45) Date of Patent: Sep. 12, 2023

(54) DIRECT ROOM ECONOMIZER

(71) Applicant: Brent Michael Joseph Lamoureux, Winnipeg (CA)

(72) Inventor: Brent Michael Joseph Lamoureux, Winnipeg (CA)

(73) Assignee: Brent Michael Joseph Lamoureux, Winnipeg (CA)

( * ) Notice: Subject to any disclaimer, the term of this patent is extended or adjusted under 35 U.S.C. 154(b) by 203 days.

(21) Appl. No.: 17/022,118

(22) Filed: Sep. 16, 2020

(65) Prior Publication Data

US 2022/0082272 A1 Mar. 17, 2022

(51) Int. Cl.

| | |
|---|---|
| ***F24F 1/56*** | (2011.01) |
| ***F24F 11/46*** | (2018.01) |
| ***F24F 11/58*** | (2018.01) |
| *F24F 110/22* | (2018.01) |
| *F24F 11/00* | (2018.01) |
| *F24F 110/12* | (2018.01) |

(52) U.S. Cl.

CPC ..... *F24F 1/56* (2013.01); *F24F 11/46* (2018.01); *F24F 11/58* (2018.01); *F24F 2011/0002* (2013.01); *F24F 2110/12* (2018.01); *F24F 2110/22* (2018.01)

(58) Field of Classification Search

None

See application file for complete search history.

(56) References Cited

U.S. PATENT DOCUMENTS

| | | | | |
|---|---|---|---|---|
| 4,186,564 | A | 2/1980 | Myers | |
| 4,347,712 | A | 9/1982 | Benton et al. | |
| 4,359,876 | A | 11/1982 | McCarty | |
| 4,462,539 | A | 7/1984 | Gilson | |
| 4,501,389 | A | 2/1985 | Kolt | |
| 5,548,970 | A | 8/1996 | Cunninghame et al. | |
| 5,937,890 | A * | 8/1999 | Marandi | F16K 5/12 137/271 |
| 6,267,667 | B1 | 7/2001 | Fikes | |
| 6,278,641 | B1 * | 8/2001 | Chen | G11C 7/222 365/230.03 |
| 6,634,422 | B2 | 10/2003 | Rayburn et al. | |
| 7,013,950 | B2 | 3/2006 | Steneby et al. | |
| 7,357,831 | B2 | 4/2008 | Dancey et al. | |
| 8,621,884 | B2 | 1/2014 | Stammer et al. | |
| 8,694,166 | B2 | 4/2014 | Quirk | |
| 8,744,632 | B2 | 6/2014 | Blackshaw et al. | |
| 9,494,334 | B2 | 11/2016 | Sipe et al. | |
| 9,766,669 | B2 | 9/2017 | Atkinson | |
| 9,845,963 | B2 | 12/2017 | Mikulica et al. | |
| 10,001,288 | B1 * | 6/2018 | Yang | F24F 11/79 |

(Continued)

OTHER PUBLICATIONS

Tameson, Ball Valve, Sep. 6, 2016, https://tameson.com/ball-valve-introduction.html (Year: 2016).*

*Primary Examiner* — Nathan L Laughlin

(57) ABSTRACT

A device and a method to provide direct room air cooling. The device is a duct-less economizer that runs independent of existing HVAC systems. The device has its own thermostat setting and is capable of providing significant insulation values when closed. In addition, the method by which the device determines the availability of cool air is improved. This is achieved by using internet weather data, to read outdoor heat indexes, instead of primarily relying on local sensors.

7 Claims, 6 Drawing Sheets

(56) References Cited

U.S. PATENT DOCUMENTS

| | | | | |
|---|---|---|---|---|
| 10,180,261 | B1 * | 1/2019 | Ross | F24F 11/30 |
| 10,495,341 | B2 | 12/2019 | Hashino et al. | |
| 10,502,445 | B2 | 12/2019 | Matambo et al. | |
| 11,231,192 | B1 * | 1/2022 | Shah | F24F 11/0001 |
| 2006/0254157 | A1 * | 11/2006 | Arjomand | E06B 7/28 52/27 |
| 2016/0076831 | A1 * | 3/2016 | Marchetti | H05K 7/20745 165/300 |
| 2018/0149275 | A1 * | 5/2018 | Rizzio | B01D 29/071 |
| 2019/0162436 | A1 * | 5/2019 | Albinger | F24F 11/89 |
| 2020/0018499 | A1 | 1/2020 | Aquino | |

* cited by examiner

DIRECT ROOM ECONOMIZER

BACKGROUND

Buildings have a wide variance of temperatures in them. Lack of shade, elevation, ventilation and the color of the structure can all significantly influence the temperature in any given room. Empirical measurement of the actual temperature in the warmest room in many buildings may be 5 to 10 C higher than the thermostat setting, especially when the thermostat is on a lower floor.

To combat this problem, the HVAC industry has devised zone control registers, to increase and decrease the amount of cool air that goes to a particular room.

Though it does save energy to control registers in such a manner, the cost and complexity of these systems is unattainable for the average consumer. In these configurations, each room needs the ability to signal to the central cooling unit that it needs to activate, even if it is only a single room demanding the cooling power. In such a scenario, all the registers in rooms that are sufficiently cool need to remain closed while the central cooling unit is active. Only when all rooms achieve sufficient cooling, does the central cooling unit shut off. This therefore requires a fixed cost overhead to the central cooling unit, to be able to be controlled in such a manner, in addition to the cost of the smart registers that interact with it.

An economizer is a device that is attached near the central cooling unit, to further improve energy efficiency of the HVAC system. This device detects the local outdoor temperature with sensors, and when it is sufficiently cool, it pulls outdoor cool air into the HVAC ducts. This supplemental cooling source not only reduces electrical demand on the compressor, but it also allows for higher total cooling capacity on some days.

The standard economizer is installed on a per-building basis, where the cool air intake goes directly into central ducts. This is a reasonable solution for buildings that naturally have a uniform temperature in all rooms. However, for buildings that exhibit abnormally warm temperatures in some areas, it would be preferable if the economizer could directly cool those rooms as a higher priority. This would save installation costs, as it would by-pass the need to install control registers in other rooms when the economizer is centrally located.

The device described in this document is specially designed to work independent of any existing HVAC system, in order to achieve improved energy efficiency, for buildings with unbalanced heat distribution. However, a few important modifications are required, for such a device to work as intended.

Unlike duct-based economizers, a standalone unit does not have the advantage of having long ducts of air to mitigate air seepage in extreme hot or cold weather. Therefore, the design requires significant improvements to the insulating properties of the device, when indoor air temperatures need to remain stable. An emphasis on R-value and an ability to prevent drafts is needed for such a device. In addition, because the device needs to be attached to a specific room, there is not as much flexibility as to where the outdoor temperature sensor can be placed. As a result, if a temperature sensor is also placed in direct sunlight, it may be extremely inaccurate, for purpose of detecting available cool air. This device therefore has an option to read temperature from a remote location, to more accurately assess outdoor weather.

SUMMARY OF THE INVENTION

For buildings that have unbalanced temperature levels in certain rooms, it is desirable to have those rooms cooled at minimal energy cost. Economizers have long been used in central duct systems, to lower power demands, but do not address the problem of local heat directly. The present device provides a means of bringing cool air into target rooms, without the need of special HVAC controls.

According to one aspect of the invention, there is provided a dynamic venting device comprising: a frame having opposing and rear sides for respectively facing indoor and outdoor environments when installed; an adjustable insulating gate located within the frame; an electric motor operable to adjust the position of the gate; a control board; and an airflow path penetrating through said insulating gate from a first end of said airpath at a first side of the insulating gate to a second opposing end of said airpath at an opposing second side of the insulating gate, wherein the motor and control board are cooperatively operable to adjust the position of the gate between an open position in which the first and second ends of the airflow path oppose one another in a front/rear direction in which the front and rear sides of the frame are spaced so that the first and second ends of the airflow path are respectively open to the indoor and outdoor environments to allow airflow therebetween via the airflow path, and a closed position in which the first and second ends of the airflow path oppose one another in a different direction closing off said first and second ends of the airflow path from the indoor and outdoor environments, thereby preventing airflow therebetween, and also trapping a volume of air in the airflow path, which serves as a gaseous insulator between the indoor and outdoor environments in said closed position of the insulating gate.

According to another aspect of the invention, there is provided a dynamic venting device comprising: a frame having opposing and rear sides for respectively facing indoor and outdoor environments when installed; an adjustable insulating gate located within the frame and movable between an open position allowing airflow through the front side of the frame to the rear side of the frame via an airflow path through said insulating gate, and a closed position preventing said airflow through said airflow path; an electric motor operable to perform movement of the gate between said open and closed positions; and a controller connected to said electric motor to affect controlled operation thereof, wherein the insulating gate is configured to trap a volume of air within said airflow path when the insulating gate is in the closed position, whereby said trapped volume of air serves as a gaseous insulator between the indoor and outdoor environments in said closed position of the insulating gate.

According to yet another aspect of the invention, there is provided a dynamic venting device comprising: a frame having opposing and rear sides for respectively facing indoor and outdoor environments when installed; an adjustable insulating gate located within the frame and movable between an open position allowing airflow from the front side of the frame to the rear side of the frame via an airflow path through said insulating gate, and a closed position preventing said airflow through said airflow path; an electric motor operable to perform movement of the gate between said open and closed positions; and a controller connected to said electric motor to control operation thereof, wherein the insulating gate is composed of a first material inside of which there is a housed at least one insulative substance that of distinct composition from said first material.

The present device installs directly in a room, independent of the existing HVAC system. It therefore has its own thermostat, and is not connected to any existing ducts. However, due to the fact such a device requires a hole in the wall, or an open window to function; it will require extra insulating properties as compared to a standard economizer. A standard economizer takes advantage of the fact that long air-filled ducts provide extra insulating properties, and therefore can be fabricated with poor insulating material, such as metal. The present device must be fabricated with higher R-value materials such as plastic with air pockets, or polyurethane, and have less air gaps to mitigate energy losses in the off-season of the device.

Furthermore, having an economizer attached to a single room limits the viable installation positions in the building. Therefore, if placed in the direct sun, the sensors of such an economizer may have wildly inaccurate readings. To mitigate this problem, the present device may be equipped with a wireless antenna, and use a method of communicating with the internet to read local weather data, to more accurately assess available cool air masses. In addition, this methodology may optionally pre-cool the room, below the thermostat value, on days where the weather forecast is expected to hot, in the hours before the temperature is expected to rise above the thermostat setting.

BRIEF DESCRIPTION OF DRAWINGS

FIG. 7 is a sketch of an exemplary harness used to hold the economizer in place, while preventing outside rain from being pulled in.

DETAILED DESCRIPTION

The standard economizer usually consists of a metal chamber attached to the ducts of an HVAC system of a building, near the air conditioning unit. The control board of the air conditioning unit can therefore be used to work in conjunction with the dampers found inside the economizer to control the air flow. This design works, partly because ducts provide implied insulation, since stagnant air has an observable R-value, even if the outer housing of such a device is a poor insulator.

The concept of having an economizer directly installed in a specific room, without the use of ducts, therefore poses a problem with regards to energy loss, while the device is in a non-circulating air state. It therefore needs to be designed in such a manner as to better insulate over a shorter distance.

In addition, because a direct room economizer would typically need to be installed in the warmest parts of a building, it is likely that, unlike the standard economizer, that it has less variability in terms of placement. This could mean that the device is in direct sun, or, has no awning coverage to prevent rain from entering the unit. The device therefore needs consideration when dealing with these problems.

Figure 1:
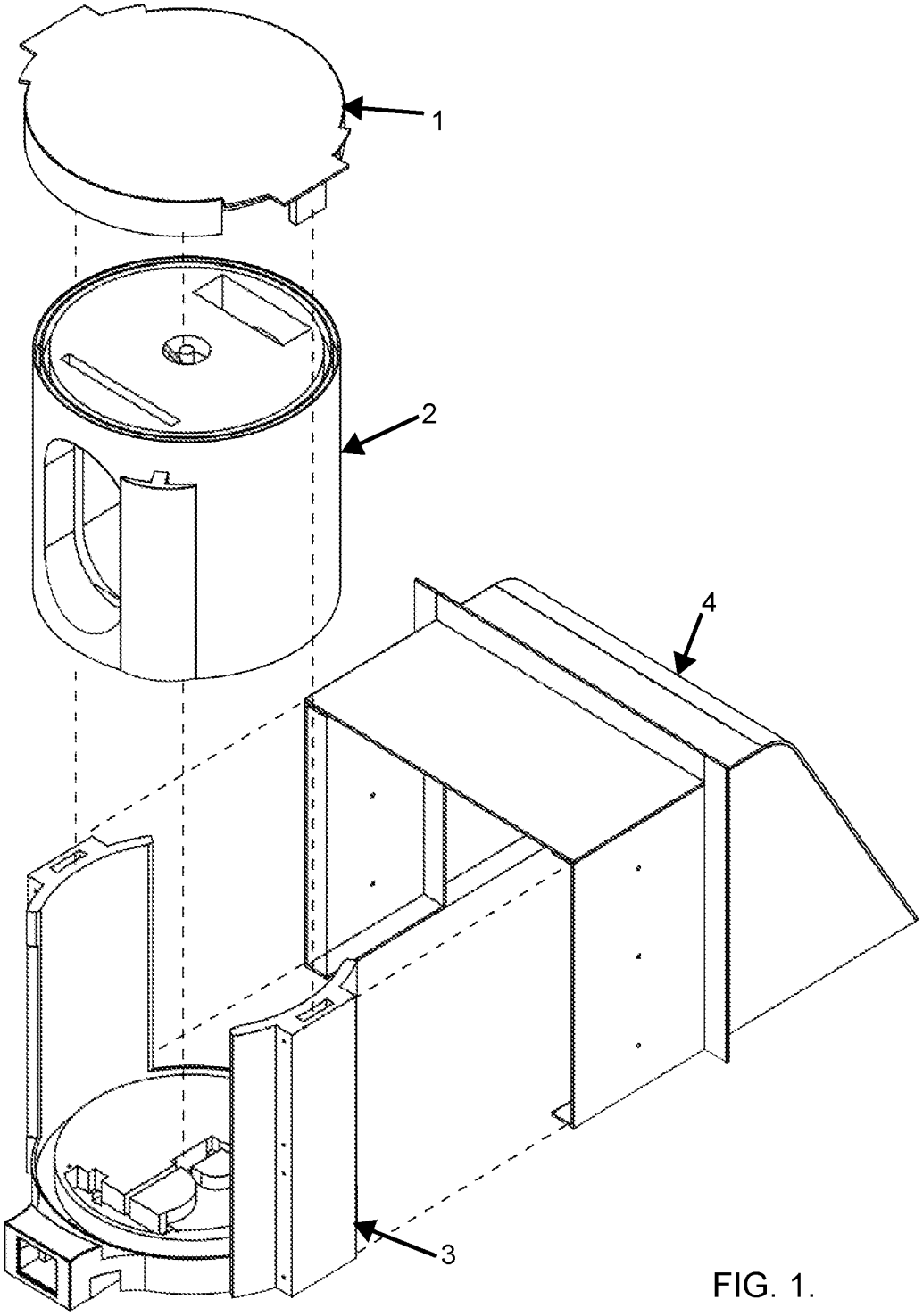
FIG. 1 is an exploded view of 3 main economizer components (lid, gate and frame), with an exemplary embodiment of a harness to hold it in place.

FIG. 1 shows an exploded view of an embodiment of a direct room economizer, with a harness that can keep rain from entering the device. The frame of the economizer is split into 2 parts; a lid (1), and the rest of the frame (3). This is done so that gate (2) can physically be placed in the frame, during fabrication. The economizer without a rain-blocking harness can be placed directly in the wall or window, in locations that already have an existing overhang or awning.

In the event there is no protection from rain, the economizer would need to be placed into a harness (4) that has an awning component that prevents rain from entering the building when air the gate is open.

Figure 2A:
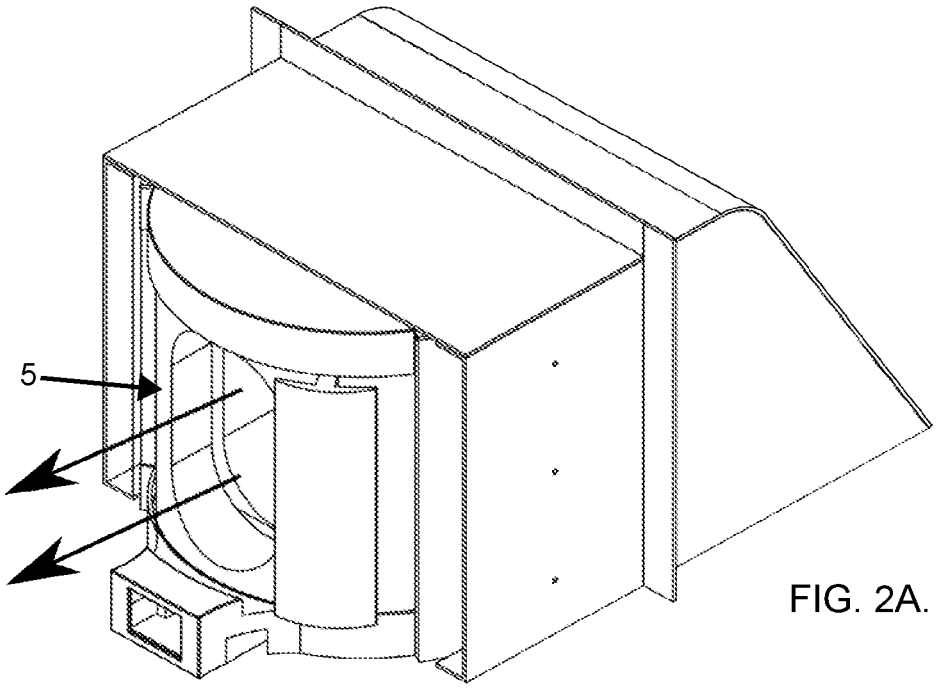
FIG. 2A is a sketch of the economizer, with harness, while in the open position, circulating outside air.

FIG. 2A illustrates the direct room economizer, with harness, showing the position of the open gate (5) when air is flowing through the device. It is worth noting that fans may be oriented, so that the air moves in the opposite direction, too. It would be typical, if multiple direct room economizers were installed in the same building, to have opposite fan directions in each economizer, to better move cool air between rooms.

Figure 2B:
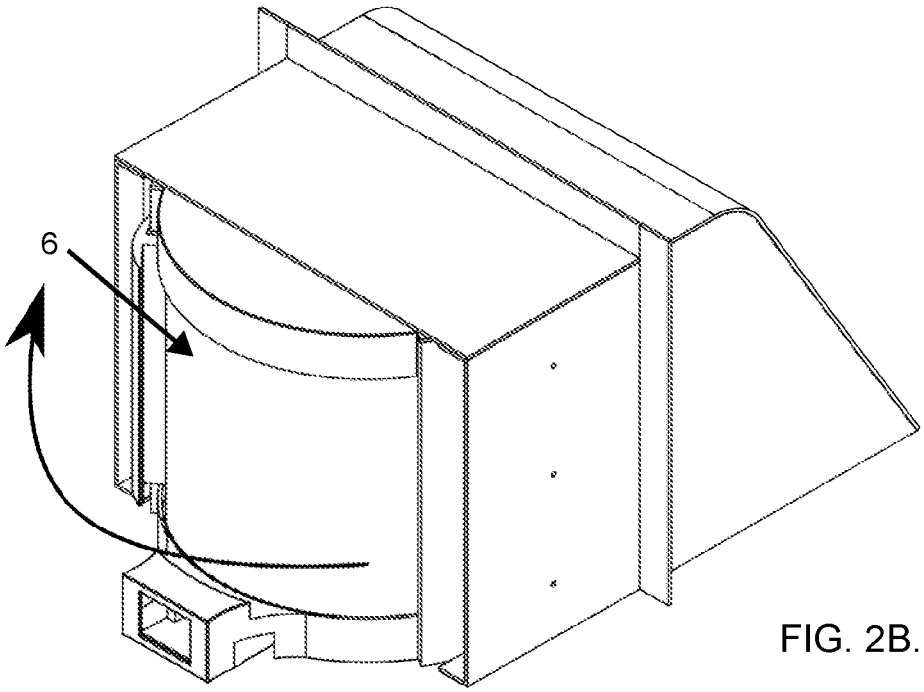
FIG. 2B is a sketch of the economizer, with harness, while in the closed position, preserving indoor air temperatures.

FIG. 2B illustrates the direct room economizer, with harness, showing the position of the closed gate (6) when outside air is too warm to provide any cooling, or, if the inside temperature is already sufficiently cool. In this embodiment, the gate is on a swivel, providing enhanced insulating properties, so as to reduce energy loss in the room when no air is to be circulated. The materials used in the frame and gate need to have a high R-value, so as to prevent heat loss during winter months. Therefore, unlike a standard economizer, metal would not be suitable. Plastic with air pockets, or polyurethane would be good options.

Figure 3A:
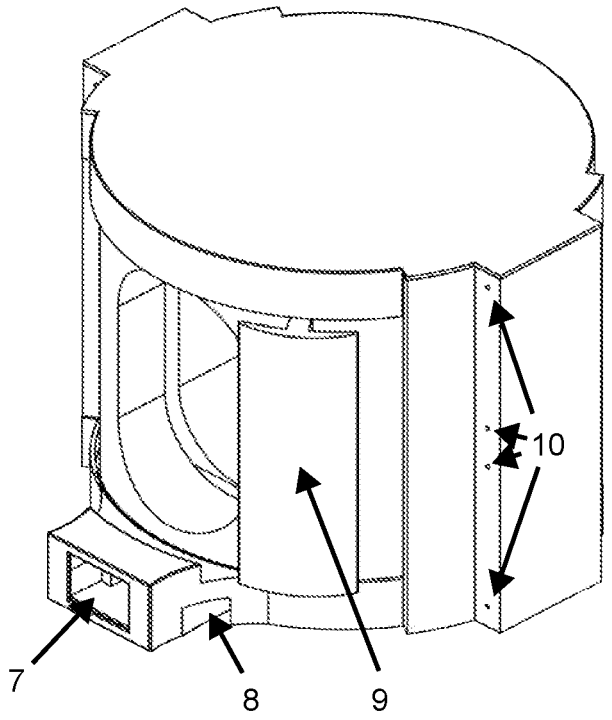
FIG. 3A is a sketch of the standalone economizer.

FIG. 3A illustrates the direct room economizer, without harness, depicting various components of the device. In this embodiment we can place a touchscreen interface (7) in the front, to allow the user to change various settings, such as the thermostat value, moving/locking position of the gate, or fan power settings. The power cable can be inserted near (8), so as not to interfere with motion of the gate. The handle (9) must be the same height as the gate opening, so as not to allow air to move through the sides of the gate opening. The screw holes (10) allow mounting of a custom trim around the front or back of the device, to match existing building styles, and to further reduce air gaps through the wall, around the frame when installed.

The total width of the device should be such that it can fit between standard wall studs. This embodiment is 14.5 inches wide, which fits between a standard wall-stud spacing of 16 inches. When no harness is present, it is presumed that the structure of the building provides sufficient protection from rain above the installation point. Installation of the direct room economizer would also typically require spray foam insulation around the frame, in the cavity of the wall, to prevent any energy losses, when the device is not cooling.

In extreme cold climates, such a device may also require an insulating cover to be mounted over the entire front face, closing seams around the perimeter of the installation. Furthermore, the device may need to make an audio notification, when extreme hot or cold weather is detected; telling the user that they need to keep the device closed and sealed in such a manner. Unplugging the device may be required when the season dictates no energy saving is possible.

Figure 3B:
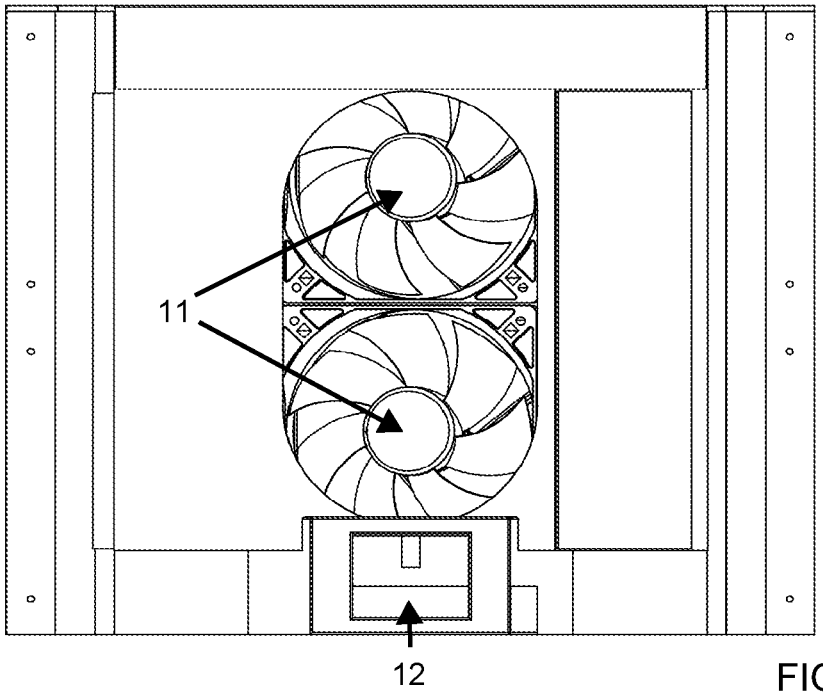
FIG. 3B is a schematic diagram of the front view of the economizer when the gate is open, depicting the internally contained fans.

FIG. 3B illustrates the direct room economizer from a front view. Here, we see the gate open, and the positioning of the fans (11) inside the gate. In this embodiment, the gates are housed inside the gate itself. They may either push or pull air out of the target room, depending on the need for negative or positive air pressure in the building. The cables running to the fans would require sufficient slack, so as to rotate and extend from the position of the control board. We also see, in this perspective, the channel which cables may run from the touchscreen into the control board (12).

Figure 4:
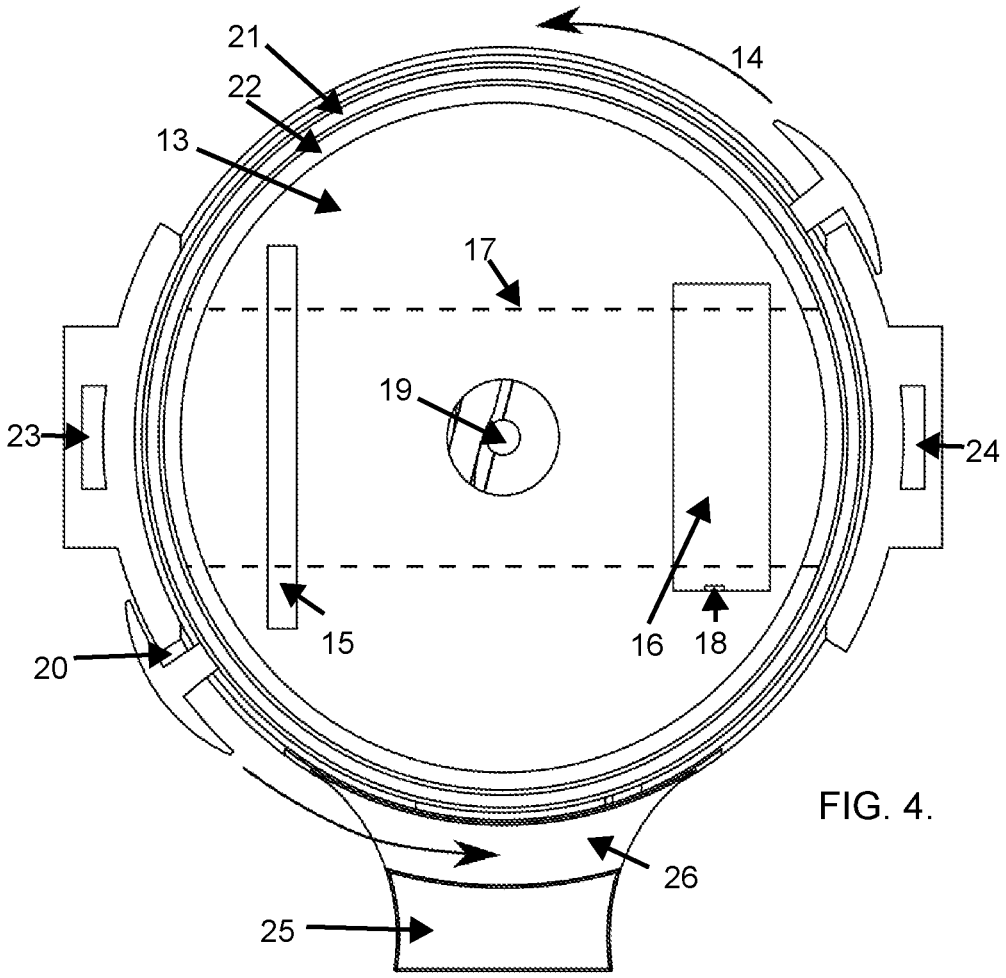
FIG. 4 is a schematic of the top view of the economizer frame and gate, with lid removed, to illustrate internal components, as well as how it physically prevents drafts with the handle design.

FIG. 4 illustrates the frame without the lid, and the top of the gate (13), from that perspective. Arrows (14) indicate the direction of motion required to move the gate from its current closed state, to an open state. We can see a slot (15) to install an air filter or bug screen, and another slot (16) to install fans along the air flow path, as seen by the dotted lines (17). The fans also require a hole (18) to allow cables to be passed through below the gate, into the frame and finally connecting to the control board. The pivot (19) is centered with a groove in the lid above it in order to reduce the resistance when the gate is moving. As seen from this view, we can also see how the handles of the gate may wrap around a portion of the frame (20) in such a manner as to elongate the air flow paths, improving the energy conservation in a closed position. Notice that, when sealed, the vertical seam is sealed twice, with the handle blocking at both the front and back of the device at the same time. The trapped air in the air flow path also acts as a further insulator, because non-circulating air provides a good R-value.

In FIG. 4, we also see grooves (21 & 22) that match up with fins in the lid, so that the top and bottom of the gate maximize air gap length, whilst not impeding motion, to further reduce unintended air passage through the device when closed. In this embodiment, there are 2 holes on the left and right of the frame (23 & 24) that the lid clips into, in order to secure the top frame lid with the bottom of the frame, securing the gate therein. As well, we see the housing for the touchscreen (25) placed in a convenient position for the user to access, while having a channel (26) for the gate handle to pass though.

Figure 5:
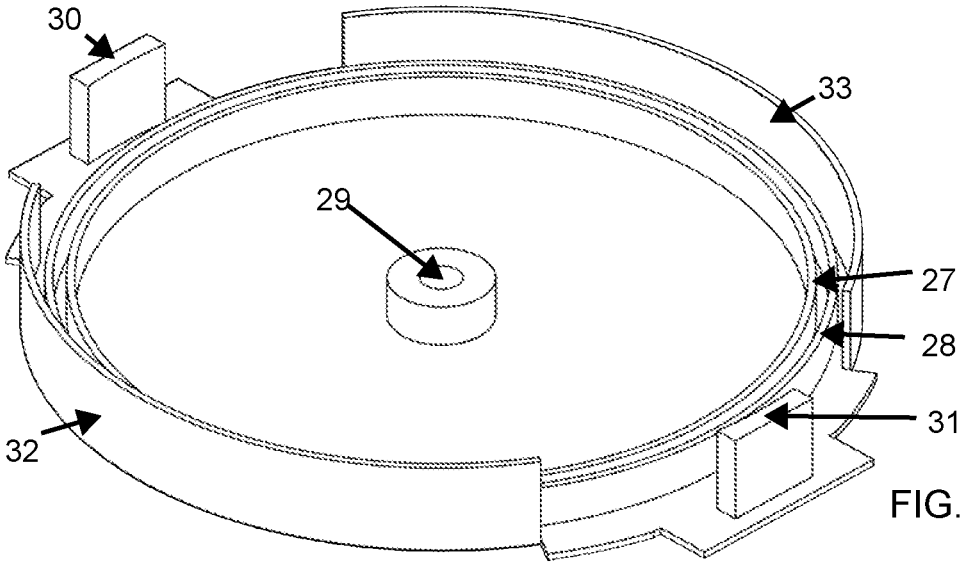
FIG. 5 is a sketch of the lid, illustrating the extra grooves that are interject with top of the gate to effectively elongate air seams to reduce drafts.

FIG. 5 is a flipped view of the bottom side of the lid that clips on to the top of the frame, securing the gate in place. Here we see the fins (27 & 28) that fit in the grooves of the gate seen in the previous figure. The elongation of air seams in such a manner allow for an economizer to be placed directly in a wall, without having a loss of efficiency, when in a closed position. The pivot housing (29) is intended to hold the pivot point of the gate below in place, reducing friction when opening and closing the gate. We also see the clips (30 & 31) that fit into the frame below it, securing the frame around the gate. The front and back lips of the lid (32 & 33) also reduce unintended air flow above the gate, when in a closed position.

Figure 6A:
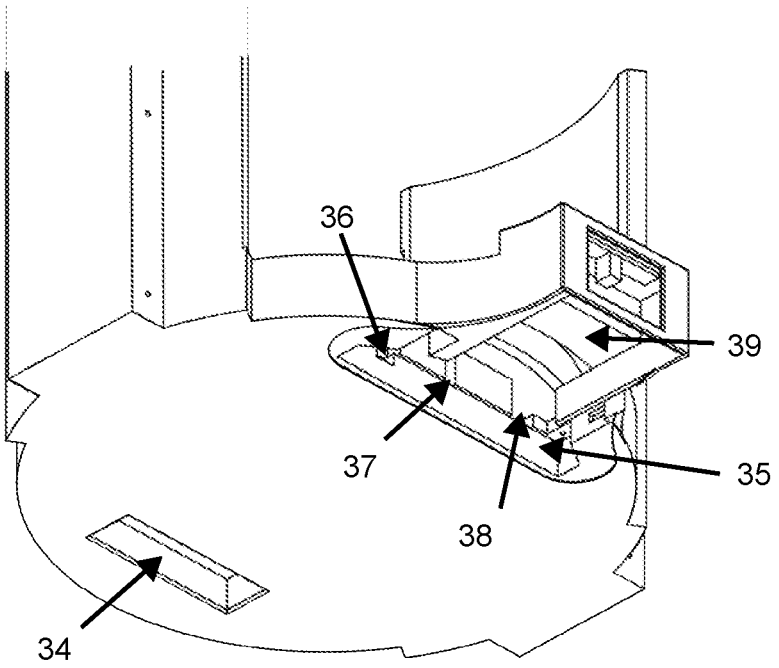
FIG. 6A is a sketch of underside of the frame, showing where indoor and outdoor sensors would be placed.

FIG. 6A shows the underside of the frame, where a rear (or outdoor) sensor can be placed (34) as well as housing for a control board (35), which may include a frontal (or indoor) sensor. The control board may be equipped with an antenna in order to enable wireless communication with Bluetooth and Wi-Fi devices. The wireless communication enables user configuration of the economizer remotely. A mobile device or a remote desktop could interface in such a manner. We also see the channels for the outdoor temperature and humidity cables (36), servo or stepper cables (37), fan cables (38) and touchscreen cables (39) to feed into the control board housing.

Because sensors exposed to direct sunlight, or, housed in devices that are exposed to direct sunlight can read as much as 10C above the actual surrounding air temperature, it is preferred to use wireless measurements that are not biased in such a manner. This is especially important for a device that has limited options for placement in a warm room. It is highly likely that the device will be placed in direct sunlight, in fact. Therefore, the preferred method when assessing whether the gate should be opened, is to use a wireless connection to the internet, in order to retrieve local weather information. However, the backup sensors may be used, as an alternative data source, should the internet not be accessible for any reason. These sensors can be reasonably reliable when the sun sets.

Furthermore, with internet access, the device then becomes capable of retrieving weather forecasts, and determining, in advance, if it is going to be a warm day. As such, we can permit a pre-cool option for these days. When pre-cooling, the device would pull cool air into the building, even below the regular thermostat settings, in the hours before the temperature is expected to rise above the regular thermostat setting. The amount of tolerance below thermostat, as well as the temperature at which we consider it a warm day, can be configured by the user. This process would further enhance the energy efficiency of the device, when enabled.

Figure 6B:
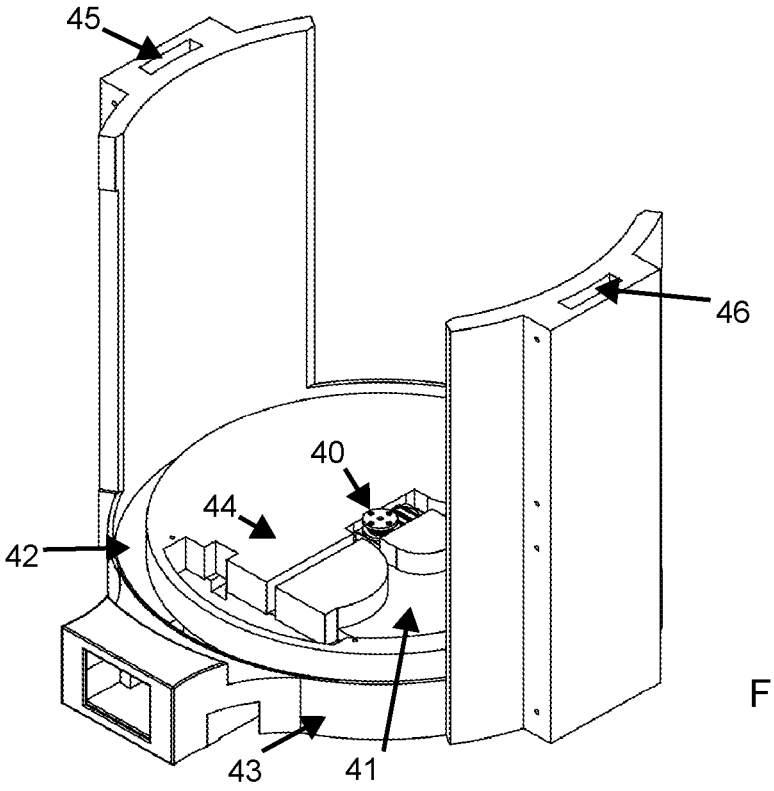
FIG. 6B is a sketch of the top side of the frame, showing where the servo or stepper is housed, which rotates the gate. Cable and PCB slots are depicted here too.

FIG. 6B illustrates the top side of the frame where a stepper or servo (40) may be placed to rotate the gate. Fan cables maybe move freely in the cavity (41) as the gate above swivels between an open and closed state. The channel at the base of the gate (42) has an elongated air seam by having the outer lip (43) of the base of the frame, and a raised center (44), to increase the air gap length between the base of the gate and the frame, reducing unintended energy loss when the gate is sealed. We also see clip slots (45 & 46) where the lid can clip to the top of the frame, securing the rotating gate from above.

Figure 7:
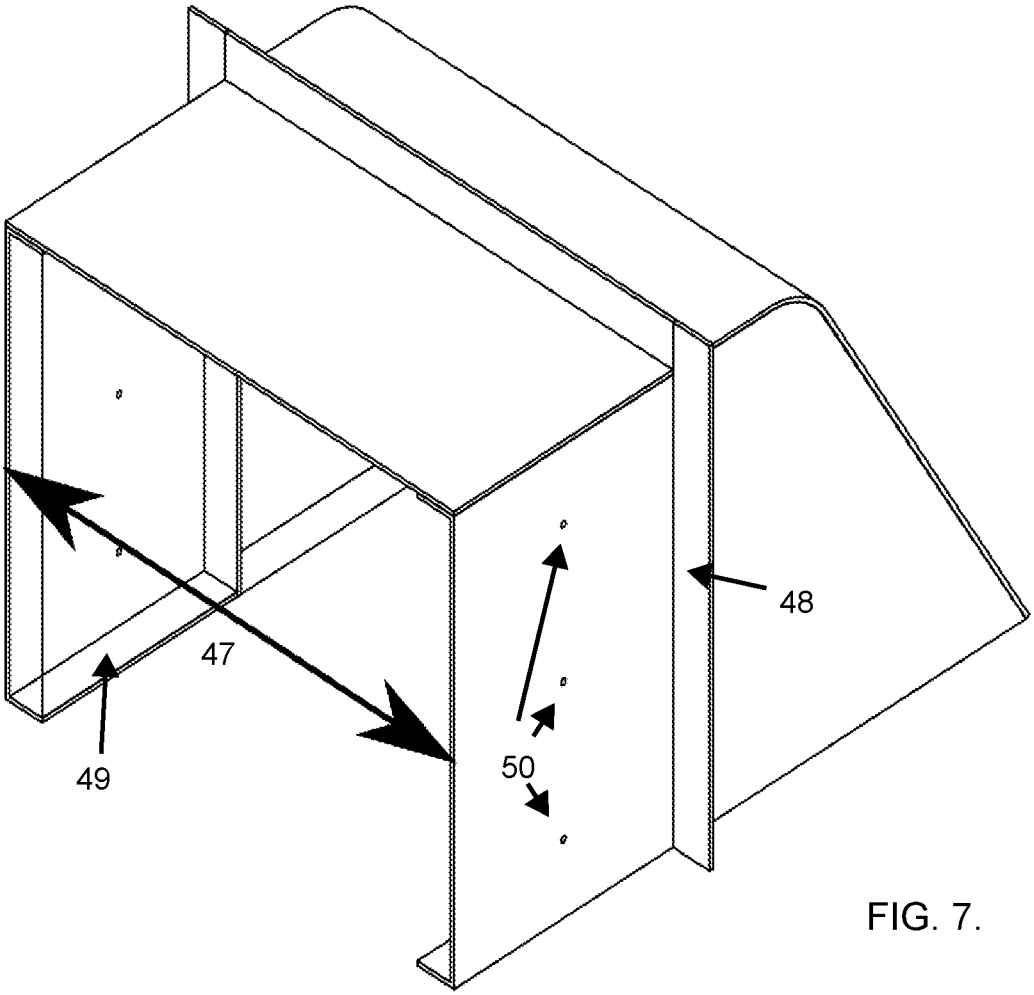

FIG. 7 illustrates an embodiment of a harness that a direct room economizer could sit in, when installed in a wall or window, where there is no exterior protection from rain. The width (47) may be sufficiently wide as to fit the economizer inside it, but not so wide that it is larger than standard wall stud spacing. A width of 14.5 inches fits perfectly between 16 inch wall studs in many buildings. When installed in such a manner, the device and harness would require sufficient bracing and spray foam insulation around the harness in extreme climates where the device and harness are intended to remain installed year-round. The lip (48) in this embodiment further reduces unintended air seams into the building by blocking seams on the external facing walls. The inner lip (49) is intended to be positioned in line with the wall itself, holding the economizer in place. Screw holes (50) can be used to attach the harness to adjacent studs.

Another embodiment of a harness, not illustrated, would be one that has a width and height matched to slide into a wall mount air conditioner slot. With the economizer permanently attached at the face of the harness in such a manner, it could replace existing wall mount air conditioners on a seasonal or year-round basis.

If the harness is built with light-weight materials such as aluminum, the net weight of it, with an economizer built into it, may be light enough to allow us to also install it by resting it against a panel of polystyrene pressed up against the front surface of a window. The opening for the harness in the polystyrene panel would be on the lower edge, when installed this way. The front lips of the harness would then press against the panel, using the weight of the awning component to hold both the panel and the harness in places. Minimal other bracing would be needed in such an arrangement and it would allow for quicker installation and removal for season installation in windows.

What is claimed is:

1. A dynamic venting and thermally insulating device comprising: a frame having opposing and rear sides for respectively facing indoor and outdoor environments when installed; an adjustable insulating gate, at least partially filled with a polymeric insulator, located within the frame; an electric motor operable to adjust the position of the gate; a control board; at least one of a bug screen, an air filter, or one or more fans contained in the insulating gate; and an airflow path penetrating through said insulating gate from a first end of said airpath at a first side of the insulating gate to a second opposing end of said airpath at an opposing second side of the insulating gate, wherein the motor and control board are cooperatively operable to adjust the position of the gate between an open position in which the first and second ends of the airflow path oppose one another in a front/rear direction in which the front and rear sides of the frame are spaced so that the first and second ends of the airflow path are respectively open to the indoor and outdoor environments to allow airflow therebetween via the airflow path, and a closed position in which the first and second ends of the airflow path oppose one another in a different direction closing off said first and second ends of the airflow path from the indoor and outdoor environments, thereby preventing airflow therebetween, and also trapping a volume of air within the airflow path, which serves as a gaseous insulator between the indoor and outdoor environments in said closed position of the insulating gate, whereby the polymeric insulator and gaseous insulator cooperatively define a thermal barrier of greater insulative effectiveness than achievable by the gate itself, absent the trapped volume of air.

2. The device in claim 1, wherein the control board comprises a wireless connection and is configured to retrieve local weather information for use in automated control of the device.

3. The device in claim 2, comprising outdoor temperature and humidity sensors positioned on the rear-side of the frame for backup use by the control board during connection outages preventing retrieval of said local weather information.

4. The device in claim 1, further comprising an awning component embodied by a harness that is separate from the frame and is sized and configured to accommodate receipt of the frame inside the harness cooperative installation of the frame and harness in combination with one another in a wall or window that lacks existing rain shelter.

5. The device of claim 1 wherein the control board runs a software program that wirelessly communicates with the internet and intermittently retrieves internet weather data therefrom, or retrieves local weather values from one or more local weather sensors attached to the economizer; and adjusts the air flow through the insulating gate.

6. The device of claim 5, wherein the software retains user settings in control board memory, said user settings include one or more of the following: an enabled/disabled status of a pre-cooling function, a tolerated pre-cooling temperature offset dictating how far below normal thermostat settings cooling will be allowed during the pre-cooling function, and an outdoor temperature threshold that, when exceeding by a forecasted outdoor temperature from the internet weather data, activates the pre-cooling function.

7. The device of claim 1 wherein the insulating gate comprises first and second handles thereon that reside at respective positions adjacent the first and second ends of the airflow path and wrap around nearby portions of the frame in the closed position of the insulating gate to achieve an effective seal to reduce unintended airflow through outer seams of the insulating gate at crossover planes between the indoor and outdoor environments.

* * * * *